US005505639A

United States Patent [19]

Burg

[11] Patent Number: 5,505,639

[45] Date of Patent: Apr. 9, 1996

[54] HYDRO-AIR DRIVE

[76] Inventor: Donald E. Burg, 15840 SW. 84 Ave., Miami, Fla. 33157

[21] Appl. No.: 309,758

[22] Filed: Sep. 21, 1994

Related U.S. Application Data

[63] Continuation-in-part of Ser. No. 201,171, Jun. 2, 1988, abandoned, Ser. No. 486,305, Feb. 28, 1990, abandoned, Ser. No. 604,741, Oct. 26, 1990, abandoned, Ser. No. 848,252, Mar. 9, 1992, abandoned, Ser. No. 922,574, Jul. 30, 1992, abandoned, and Ser. No. 118,029, Sep. 8, 1993, abandoned.

[51] Int. Cl.[6] ..... B63H 11/01; B63H 11/103; B63H 11/113; B63H 11/117

[52] U.S. Cl. ..... 440/42; 440/43; 440/46; 440/47

[58] Field of Search ..... 440/38, 40, 42, 440/43, 44, 46, 47; 60/221, 222; 114/151

[56] References Cited

U.S. PATENT DOCUMENTS

| | | | |
|---|---|---|---|
| 3,109,407 | 11/1963 | Dorst | 440/46 |
| 3,233,573 | 2/1966 | Hamilton | 60/222 |
| 3,279,414 | 10/1966 | Rabald | 440/46 |
| 3,589,325 | 6/1971 | Tattersall | 440/38 |
| 3,598,080 | 8/1971 | Shields | 440/38 |
| 3,805,731 | 4/1974 | Furst et al. | 440/47 |
| 3,824,946 | 7/1974 | Macardy et al. | 440/43 |
| 4,223,630 | 9/1980 | Keeney | 440/42 |

FOREIGN PATENT DOCUMENTS

| | | | |
|---|---|---|---|
| 2217171 | 10/1973 | Germany | 440/43 |
| 3726241 | 2/1989 | Germany | 440/43 |

*Primary Examiner*—Sherman Basinger

*Attorney, Agent, or Firm*—Robert J. Van Der Wall

[57] ABSTRACT

An improved marine propulsion system that offers an attractive design with no external cables, gears, or the like and exceptional high speed performance is presented. It uses a unique new rotor concept that is supplied with water over the majority of a lower semicircle of its rotation and air over the top half of its rotation in the preferred embodiment. Since the rotor is pumping water over the lower half of its rotation the rotor sees greater average water inlet pressures than a standard full water flow waterjet. This results in improved efficiencies, especially at higher vehicle speeds. It is possible to vary the level of water flow into the rotor vanes by adjustment of an inlet flow regulating valve which results in adjustment in levels of power absorption. It is also possible, in most configurations, to run with the rotor filled with water which offers advantages at low vehicle speeds. Another feature is the aspiration of drive engine exhaust into the rotor which improves engine performance. Further rotor improvements include a rotor vane ring to enhance the structural integrity of the rotor vanes. The rotor vane ring is normally inset into a housing recess with the recess supplied with gas. This improves efficiency since there is little or no hydrodynamic drag of the rotor vane ring. Other features include a bearing oil fill inside of the vehicle and a debris cutter attachment that can be removed with the inspection port cover. There is a steering and maneuvering system whereby the discharge waterjet is directed aft to the steering system during normal ahead operation while it is redirected to a separate maneuvering system for precise low speed reversing and control. In the preferred embodiment, the maneuvering system offers full 360 degree maneuverability by directing fluid discharge through a rotatable nozzle. The nozzle openings can be shielded from water impingement during full ahead operation by water separating steps.

102 Claims, 7 Drawing Sheets

HYDRO-AIR DRIVE

CROSS REFERENCE TO OTHER APPLICATIONS

This application is a continuation-in-part to applicant's earlier applications, Ser. No. 201,171 filed Jun. 2, 1988, now abandoned, Ser. No. 486,305 filed Feb. 28, 1990, now abandoned, Ser. No. 604,741 filed Oct. 26, 1990, now abandoned, Ser. No. 848,252 filed Mar. 9, 1992, now abandoned, Ser. No. 922,574 filed Jul. 30, 1992, now abandoned, and Ser. No. 118,029 filed Sep. 8, 1993, now abandoned.

BACKGROUND OF THE INVENTION

Enclosed rotor full water flow waterjet propulsors have been commercially available as marine propulsors for many years. Compared to conventional propellers they offer the advantages of shallow draft, a reversing system that does not require a gearbox, reduced underwater noise, more even engine loading, and the safety and damage resistance of enclosed rotors. However, even with the aforementioned advantages they have not been overly successful in market penetration compared to propellers.

They are generally not as efficient as propellers even when their reduced appendage drag compared to propellers is considered. This is especially so in smaller sizes and/or at low vehicle speeds. They also suffer from a more narrow design speed range of efficient operation with part of that limitation due to a restriction for operation at low boat speeds and high power levels where rotor vane cavitaion can occur. They are also generally several times as expensive as a comparable power propeller drive system.

The instant invention offers greater efficiencies than the standard water jet and also provides a way to vary rotor flow and power absorption thereby insuring greater off design efficiencies. Further, due to its unique concept rotor that operates only partially submerged during normal operation, it is mostly immune to cavitation damage.

Normally, during vehicle high speed operation, the preferred embodiment of the instant invention uses only the lower part of the rotor to pump water while the upper part pumps gases that are ambient air (gas) and/or engine exhaust gas. The gas is normally injected upstream of the rotor. Because of its operating parameters, applicant has coined the name Hydro-Air Drive, and its acronym HAD, for the propulsor presented herein as the instant invention. The immediately following discussion is made to show a reason for higher efficiencies of the instant invention.

Measurements have been made by Pratt & Whitney Aircraft and others of the efficiency of inlet pressure recovery in standard water jets. These have shown that inlet pressure recoveries, measured just upstream of the rotor inlet, average above 90 percent over the bottom half of the rotor and closer to 55 percent over the top half. This results in overall inlet efficiencies of only about 70 percent. It is obvious that, since the instant invention's rotor sees the majority of its inlet water flow over its bottom half, the instant invention realizes inlet efficiencies of at least 90 percent. When this is factored into the thrust calculations, the instant invention shows improved thrust values vis-a-vis the standard full water flow rotor water jet. This improvement increases with vehicle speed as the inlet pressure recovery is a bigger part of overall pressure head available at the rotor discharge at higher vehicle speeds. For example, the calculated thrust for the instant invention is approximately twenty percent higher at a vehicle speed of 40 knots.

By way of definition, vehicle speeds of up to fifteen knots are considered as low speed and vehicle speeds over fifteen knots as high speed for purposes of this application.

Haglund, International Patent Publication Number: WO 88/05008, has a means to inject air into a water jet housing. Haglund proposes a means to plug the discharge of a water jet nozzle when the jet is not in use by means of an inflatable ball plug. He then pumps air into the waterjet to displace all of the water in the pump housings. The benefit of this is to keep the pump housing and rotor clear of growth and contamination when not in use for extended periods. It would be possible to inject air into the water upstream of the rotor in Haglund's water jet when the rotor is rotating and pumping water. However, there is no way to separate the air from the water by a waterline with the rotor rotating and pumping so a turbulent mixture of air and water would result. This actually serves to decrease the efficiency of Haglund's water jet since the turbulent mixture of air and water decreases the efficiency of his rotor. This is actually the case and the intent of Joyner et al., United Kingdom Patent GB 2141085A, who has gas injection means upstream of his water jet rotor and states "By providing the means for introducing gas into the water intake casing and for varying the amount of gas introduced (which means can be a simple bleed valve), the efficiency of a unit can be decreased in accordance with the amount of gas introduced is important to state here that the instant invention has means to create a separation of gas and water upstream of the rotor and does not have a turbulent mixing of gas and water upstream of the rotor vanes as is the case with Haglund and Joyner et al. who have no means to separate the gas and water upstream of the rotor.

In a related technical development, water jet rotor air injection tests were run at Pratt & Whitney Aircraft in 1967–69 in attempts to reduce cavitation damage to the rotor of a 3,200 HP water jet. It was felt that the presence of air would absorb some of the material damaging explosive forces on the rotor blades caused by collapsing cavitation vapor bubbles. The air was injected upstream of the rotor in a similar manner to that shown by Haglund and Joyner et al. and did indeed reduce the rotor cavitation damage since the air was automatically thoroughly and turbulently mixed into the incoming water. However, air volumes of only a few percent of total rotor flow volume were possible before a very sharp decrease in rotor efficiency occurred. These tests proved that a simple turbulent mixing of air into the water upstream of a rotating waterjet rotor, which is the only effect that Haglund's and Joyner et al's systems could provide, actually has a detrimental effect on water jet performance. The instant invention has a clear separation of the water and gas upstream of the rotor as is defined by a waterline in the preferred embodiments. The separating waterline is insured by use of a means to direct the water prior to its reaching the rotor in the instant invention.

Smith, U.S. Pat. No. 3,785,327 has an engine cooling water pickup positioned upstream of his rotor which cannot dispense gas into his water inlet. He has a high resistance forward facing or reverse hinged inlet flap for restricting and/or shutting off water flow to his rotor. Partial closing of Smith's inlet flap will only result in a pressure drop in the liquid flow supplied to his rotor. Critically important is the fact that Smith has no means to inject gas into the rotor inlet and therefore cannot have a separation of gas and liquid at the rotor inlet as is a primary requirement of the instant invention. As such, there is no relation between Smith's invention and the instant invention Further, the instant invention uses a special rotor that operates similar to a surface piercing propeller and does not, in its preferred embodiment, use a full water flow nozzle to control flow and velocity of water downstream of the rotor and out of the water jet which is normal and required for state-of-the-art waterjets. Instead, the instant invention uses a mostly open discharge, sometimes aided by efficiency improving flow straightening vanes, that allows water and air to discharge freely out the back of the drive. The result of all of this is that the instant invention offers a dramatic departure from and dramatic improvements over existing water jet design technology..

There are some propeller systems that operate with only portions of the propeller submerged as exemplified by Van Tassel U.S. Pat. No. 4,941,423 and Kruppa et al. U.S. Pat. No. 4,371,350. These type of propulsors are normally called surface piercing propellers. Both operate with the lower portions of their propellers exposed which differs extensively from the preferred embodiment of the instant invention which has a housing essentially fully around its rotor in an encircling manner. The instant invention's use of an inlet housing and encircling rotor housing and/or rotor vane ring results in greater rotor efficiencies but at the expense of some additional resistance since the lower portion of the housing is exposed to the passing water. The instant invention has overcome most of the just mentioned housing resistance since the majority of its housings are behind the transom and/or inside the boat hull. Because they do not have fully or even partially enclosing rotor housings and therefore have propellers that are exposed over substantially the entire lower half of their rotation, the inventions of Van Tassel and Kruppa et al. bear little resemblance to the instant invention it be noted that the instant invention can be configured with a majority of the upper half of its rotor exposed and free of structure while the majority of the lower half of its rotor is enclosed which is the exact opposite of Van Tassel and Kruppa, et al.

Guezou et al. U.S. Pat. No. 4,929,200 presents a waterjet that has air injected downstream of the rotor in the stator section. The purpose of this, according to the inventor, is to agument thrust with large amounts of air mixed with the water of the rotor. Guezou has a rotor that is supplied with water from a fluid filled duct so there is really no relation of Guezou and the instant invention that uses an approximately half full rotor portion at high vehicle speeds.

The instant invention also offers a new simple steering and reversing system. It consists of independently steerable side rudders and/or a center rudder in the preferred embodiments. When reversing is desired, it is possible to prevent flow from discharging aft by deflecting the steering rudder(s), or by other water flow blocking means, such that they block the discharge passageway. By so doing, water is then directed to a maneuvering device that can accomplish full 360 degree maneuvering in its preferred embodiment. The maneuvering device(s) include a nozzle that is normally oriented in a forward position when it is not use to offer a minimum or resistance to water discharging from the rotor vanes. It is also preferably shielded by a deflector step to prevent water that is going astern from hitting it.

In the preferred embodiment of the instant invention, the steering rudders are driven through right angle gears by servo motors located inside the hull. Other means of driving the rudders are within the scope of the invention, however, the servo motors are preferred as they are simple and reliable.

Side rudders are shown by Hamilton U.S. Pat. No. 3,007, 305 and 3,233,573 however, his side rudders operate in unison and are positioned aft of a vertically operating reversing gate. Hamilton accomplishes steering in reverse by means of steering the rudders. As such, there is little resemblance to the simple compact design of the instant invention with its rotatable angled maneuvering device(s). An added feature of the instant invention is that maneuvering, normally a full 360 degrees, is possible while the water flow is blocked from discharging to the rear.

Macardy et al. U.S. Pat. No. 3,824,946 and Van Veldhuizen U.S. Pat. No. 4,421,489 present, respectively, a water jet steering system and an air propeller propulsor both with side steering rudders. They have means to control the side rudders or steering blades such that they can go perpendicular to the discharge flow. This has the effect of blocking the discharge flow and forcing it to reverse and/or go sideways to accomplish reversing. Neither Macardy nor Van Veldhuizen has a rotatable maneuvering device(s) as does the preferred embodiment of the instant invention. As such, neither can supply 360 degree rotatable maneuvering forces with the flow blocked from discharging aft as can the instant invention. Because of the foregoing reasons, there is obviously little resemblance between Macardy's and applicant's instant invention.

Joyner et al., United Kingdom Patent GB 2141085A, offers a marine pump with a 360 degree steerable discharge that is only useful as a low speed maneuvering system. This is because the pump discharge flow is always discharged downward and to the discharge maneuvering system which results in high internal flow losses and high underwater drag. The instant invention offers the maneuvering capability of Joyner et al. when its discharge flow is blocked from going straight rearward; however, the instant invention has a free opening directly behind the rotor vanes that discharges rearwardly directly in-line with the rotor shaft centerline when the instant invention is in the high speed forward mode. There is no flow through Applicant's maneuvering device unless there is a blockage of flow rearward from the rotor vanes while Joyner et al. always has rotor discharge through his maneuvering system as he has no other way to discharge fluid from his rotor vanes. There is also no excessive underwater drag with the instant invention as its maneuvering device components are, at least primarily, free of water flow from under the boat. As such, there is little resemblance between Applicant's instant invention and Joyner et al.

Mamedow, German Patent 2,217, 171, has a reversing system that includes a series of louvres inside of a steering ring to accomplish 360 degree steering when flow is blocked from exiting rearward by a steering flap. Mamedow's louvres are set in a full circle and as such are subject to direct impingement by water discharging from his rotor and from water exiting below the boat when in the normal full speed ahead mode of operation. Applicant's invention's use of discharge nozzle(s) or orifice(s) biased to one side of his maneuvering device acts to prevent water from hitting the nozzle openings when in the normal ahead mode of operation. Applicant's invention normally would have his maneuvering device set into a forward thrust orientation when not used for maneuvering. Further, applicant offers a step to break the water flow from hitting the nozzle openings in his maneuvering device during normal full speed ahead operation. Also, the instant invention offers multiple maneuvering devices, each having nozzles, that have coordinated movement to reduce overall axial length requirements. These notable improvements in concept clearly define over Mamedow's patent.

Applicant's instant invention offers other features. Importantly included is an optional rotatable curved, preferably circular arc shaped, inlet water directing valve that, when in the low boat speed closed mode, directs water to the full 360 degrees of rotor rotation. This is accomplished by means of the Coanda Effect whereby water flow tends to follow curved surfaces. Other inlet valve and/or structural discontinuities are also offered as ways to separate water and gas flows from upstream of the rotor. Another very important feature is that the inlet valve can act as a means to control gas flow, including a complete shut off of gas flow, to the rotor vanes.

Other features of the instant invention include an attractive cover that shows no cables, gears, or other such moving parts, a simple bearing oil fill and check plug located inside the boat, a means to discharge the engine exhaust simply and cleanly into the rotor which also improves engine performance since the rotor is drawing or aspirating the gas discharge from the engine, an inset in the housing for a rotor vane ring with such inset being supplied with gas to reduce water drag on the rotor vane ring, a blade like attachment to the inspection cover that slices weeds, rope, etc. between the blade like attachment and the front end of the rotor, and a means to vary flow into the rotor and thus effect water discharge velocity, power consumption, and performance.

Further notable advantages are derived from use of the rotor vane ring inset into the housing. First, the overall hydrodynamic efficiency is raised because the rotor vane ring acts to reduce rotor blade tip leakage. There is little penalty for this rotor vane ring since its periphery sees mostly air rather than water in its preferred embodiment and therefore has little drag. Also, since the rotor vane ring is inset into the housing it has little hydrodynamic resistance in the main flow path. Second, and very importantly, the rotor vane ring makes for a structurally sound rotor so less expensive rotor materials can be used. Third, since, due to the rotor vane ring, there is little or no abrasive action between sand or other particles and the housing in the area of the rotor vane ring it is possible to use less expensive housing materials. For example, most water jet designs use stainless steel housings around the rotor while the instant invention, when equipped with a full shroud type rotor vane over the full longitudinal length of the rotor blades, can use structural foam, fiberglass, or other less expensive materials.

SUMMARY OF THE INVENTION

With the foregoing in mind, it is the principal object of the present invention to provide a new marine drive that has a rotor that operates while at least primarily enclosed by structure and while receiving water over a majority of 180 degrees of its rotation and gas over a majority of 180 degrees of its rotation and that provides very high operating efficiencies at high vehicle speeds since the rotor receives the majority of its inlet water flow at high inlet recovery efficiencies.

A related object of the invention is that the rotor receive liquids mainly over a lower portion of its semicircle of rotation and that such lower portion of its semicircle of rotation be primarily enclosed by structure.

It is a further related primary object of the invention that the rotor vanes be capable of accelerating liquids over a portion of their rotation and gases over another portion of their rotation while still operating at high rotor vane efficiencies.

A further primary object of the invention is to provide a waterline between water and gas upstream of the rotor when the rotor is rotating and the drive is propelling the vehicle.

Another primary object of the invention is to provide means to vary the inlet flow to the rotor so that propulsor power absorption and performance can be varied.

It is a further intended that an inlet flow control valve can direct liquid flow to selected portions of the rotor vanes.

A preferred object of the invention is that the inlet flow control valve can be smooth and curved, a generally circular shape is preferred, such that water follows said curved shape due to the Coanda Effect whereby water flow tends to follow smooth curved surfaces.

A related optional object of the invention is that the inlet flow control valve can be of a hinged flap configuration.

It is another object of the invention that a fixed structural discontinuity can be utilized to separate the water or liquid flow from the gas flow going to the rotor vanes.

It is a further related object of the invention that the inlet flow control valve can be positioned downstream of an inlet grille.

It also an object of the invention that the rotor can be operated with the rotor filled with water at least during part of its operation and particularly at low vehicle speeds.

A further object of the invention is that an inlet flow passage can terminate proximal to forward portions of the rotor vanes thereby delivering water to only a portion of the rotor vanes during rotor rotation at high boat speeds.

Yet another object of the invention is that an open discharge that does not noticeably restrict the discharge of fluids from the propulsor can be used.

Another object of the invention is that drive engine exhaust gases can be directed to the rotor vanes.

A further related object of the invention is that a gas supply to rotor vanes can be controlled by a valve like apparatus which can be at least partially the inlet flow control valve.

It is furthermore intended that a gas supply to rotor vanes can be shut off thereby resulting in the duct upstream of the rotor vanes being filled with liquids.

It is also an object of the invention that, optionally, a rotor vaned ring can be placed around all or portions of the rotor vanes.

It is a related object of the invention that a rotor vane ring can be inset into a recess in an adjacent housing.

A further related object of the invention is that such recess can have a passageway supplying it with gas to thereby reduce wetted area resistance of the rotor vane ring.

A related object of the invention is that a water discharge be connected to a rotor vane ring recess to thereby expel water from such recess.

Another related object of the invention is that a seal be disposed to restrict leakage around a rotor vane ring.

It is a directly related object that the just mentioned seal be, at least in part, of a labyrinth configuration.

It is another object of the invention that a rotor vane ring have fluid pumping means that can direct liquids away from the motor vane ring.

It is a further object of the invention that encircling of the rotor can be accomplished by a housing, one or more rotor vane rings, or a combination thereof.

It is another object of the invention that the rotor can operate with portions not enclosed by structure.

Yet another object of the invention is to provide for flow straighteners downstream of the rotor vanes.

A related object of the invention is that flow straighteners positioned downstream of the rotor vanes include a series of vanes.

Yet another object of the invention is to provide an inspection port with said inspection port having an opening that is positioned inside of the vehicle in the preferred arrangement.

Another object of the invention is to have a weed and/or rope cutting apparatus, called a debris cutter herein, positioned near the front face of the rotor.

A related object of the invention is to have the debris cutter attached to the inspection port cover such that removal of the inspection port cover also removes the debris cutter.

A further object of the invention is to have a noncircular, generally rectangular, shaped inlet with a connecting duct that transitions to circular at the rotor.

It is a further object of the invention that an inlet grille composed of a series of inlet grille bars be placed in the inlet to preclude debris ingestion into the propulsor with said inlet grille bars normally being at least palatially airfoil shaped.

It is intended that the inlet lip be of a generally airfoil shape to minimize resistance of such inlet lip.

It is also an object of the invention that a steering and reversing mechanism can be provided.

A related object of the invention is that forward steering can be accomplished by way of steering rudders positioned either side of a vertical centerline plane of the propulsor A further related object of the invention is that the steering side rudders are independently steerable.

An optional version of the invention utilizes a more centered rudder.

It is also an object of the invention that the shape of the discharge where the steering side rudders are positioned shall be generally rectangular.

Yet another object of the invention is to have a reversing mechanism, comprised at least primarily of the rudder(s), to block, either partially or fully, rearward flow of fluids in line with the centerline of the rotor.

An optional object of the invention is to provide a separate reversing mechanism from the rudder(s) to block either partially or fully, rearward flow of fluids in line with the centerline of the rotor.

It is a related object of the invention that the reversing mechanism be designed to have balanced forces during its operation thereby minimizing the forces required to actuate it.

It is a further related object of the invention that, when the flow is blocked in reverse, the flow be directed to a maneuvering device that can accomplish, at least in the preferred embodiment, full 360 degree maneuvering forces including reversing.

It is a related object of the invention that the power for operation of the steering rudder and the maneuvering devices be by independent drive means.

It is a directly related object of the invention that the independent drive means for the rudder(s) and the maneuvering device be electric motors.

It is a further related object of the invention that the maneuvering device can contain flow directing nozzle (s) or orifice (s).

It is a related object of the invention that the flow directing nozzle(s) in the maneuvering device be placed such that their inlets and discharges are biased to one side of the maneuvering device.

Another object of the invention is to provide a water separating step in the maneuvering device to deflect water from impacting the nozzle(s) openings.

Another object of the invention is to provide a water separating step in the housing forward of the maneuvering device to thereby minimize water from contacting the maneuvering device's nozzle openings during normal ahead operation.

Another object of the invent ion is to have a bearing lubrication oil and fill plug located where it is accessible inside of the vehicle.

A related object of the invention is to have propulsor bearings located so that a common lubrication system can be used.

A further object of the invention is to have an axial thrust absorbing bearing mounted in an easily removable bearing cartridge.

It is another object of the invention that a gearbox can be placed between the drive engine and the propulsor and that such gearbox can have multiple gear ratios.

It is a further important object of the invention that the portions of the propulsor that extend outboard of the vehicle be covered by an attractive cover that precludes seeing steering cables, gears, and the like.

The invention will be better understood upon reference to the drawings and detailed description of the invention which follow in which:

DETAILED DESCRIPTION

FIG. I shows a top plan view of the instant inventive propulsor 48 as installed in a boat 49. In this instance it is propelled by engine 50-that drives through gearbox 51. Also shown is the centerline 75 of the propulsor 48.

Figure 2:
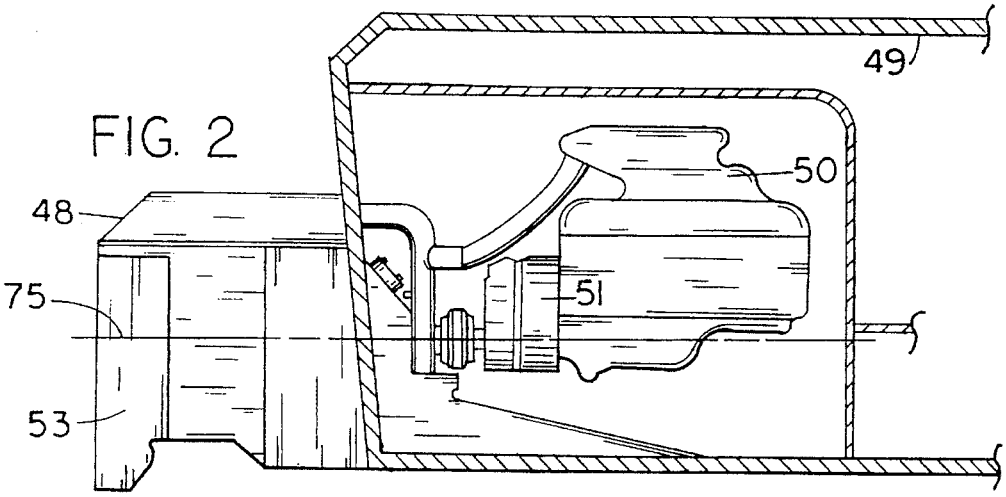
FIG. 2 shows a profile view of the propulsor and a drive engine and gearbox as installed in a boat hull.

FIG. 2 presents a side view of the inventive propulsor 48 showing a starboard rudder 53. Note the simple clean layout of this new improved marine propulsor since it has no exposed cables, gears, or the like.

Figure 3:
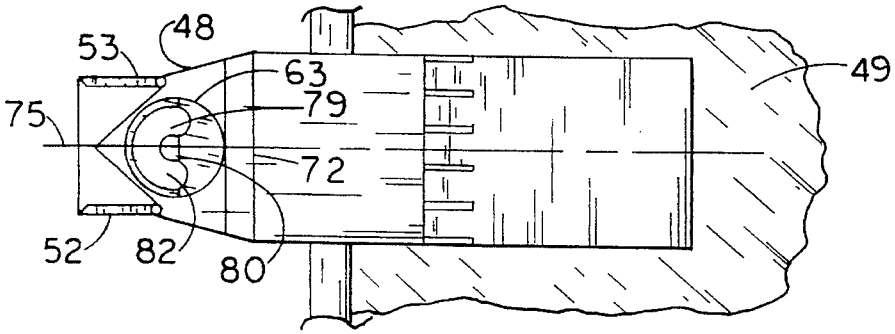
FIG. 3 is a bottom plan view of the propulsor installed in a boat hull. Note the water inlet grille bars forward and rotatable maneuvering device including maneuvering device with its nozzle discharge opening shown as biased rearward for ahead thrust in this instance.

FIG. 3 is a bottom plan view of the improved propulsor 48 showing port rudder 52 and starboard rudder 53 in their ahead positions. Also shown is a center maneuvering device 63 and its nozzle 79. The nozzle discharge opening 82 is, in this instance, oriented for ahead thrust to minimize resistance due to water impact. The maneuvering device water separating step 80 is also effective for reducing water impact resistance.

Figure 4:
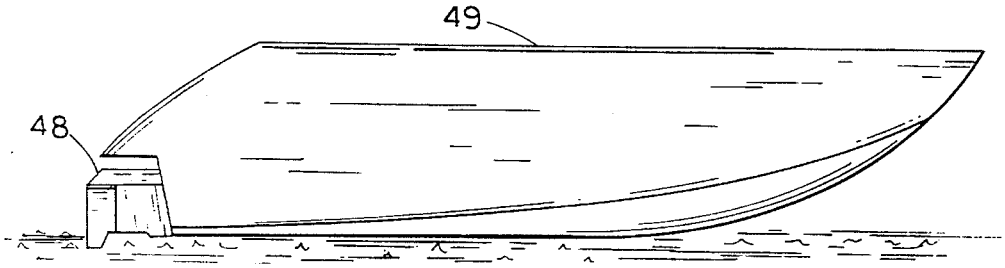
FIG. 4 gives a profile view of a boat hull with the propulsor installed. Note the clean design and the absence of external cables and the like as is easily apparent from examination of FIGS. 1–4.

FIG. 4 presents a profile view of a boat 49 with the improved propulsor 48 installed.

Figure 1:
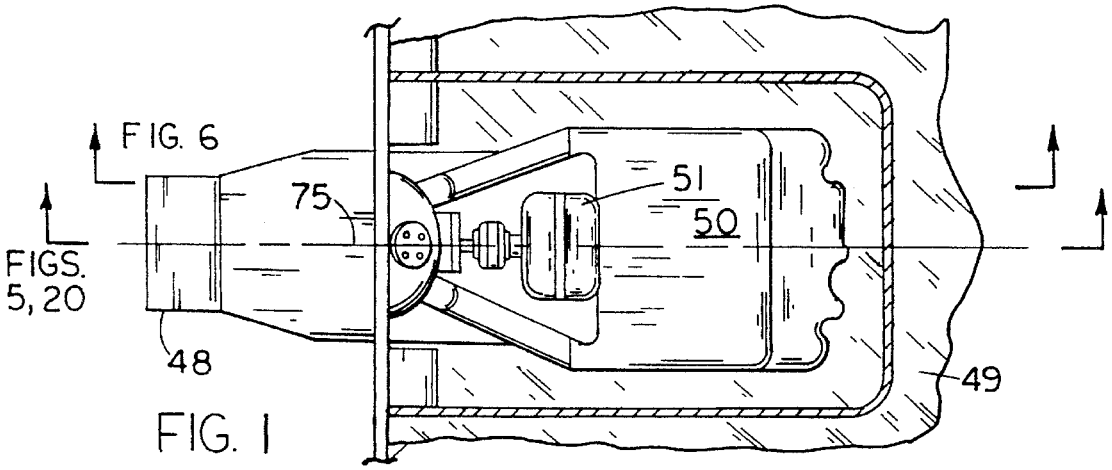
FIG. 1 presents a topside plan view of the instant invention Hydro-Air Drive propulsor and a typical drive engine and gearbox as installed in a boat hull.
Figure 5:
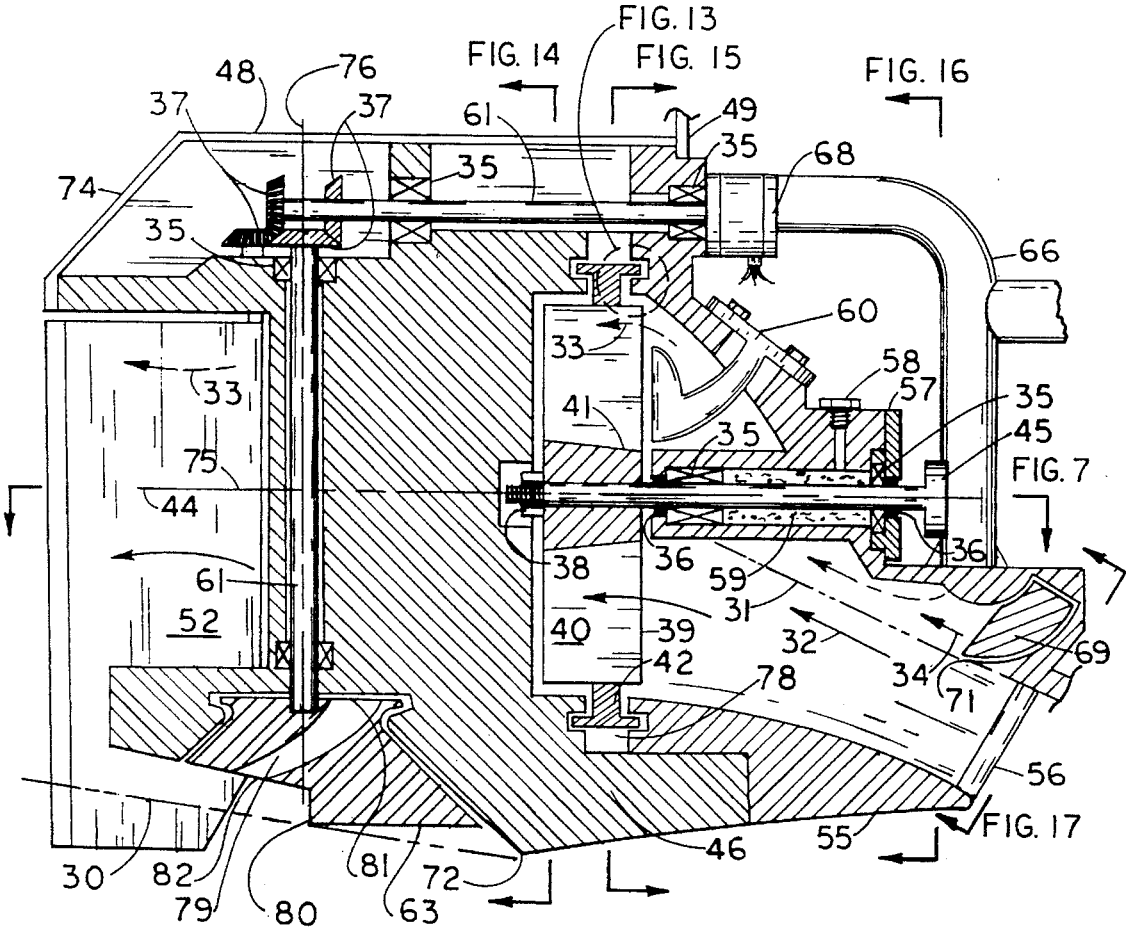
FIG. 5 is a centerline cross sectional view, as taken through line 5—5 of FIG. 1, that shows typical workings of a preferred embodiment of the inventive propulsor. Note the waterline internal to the inlet housing that separates liquid and gas flow. Note also the maneuvering device with its nozzle pointed rearward on its lower or discharge side in its ahead thrust orientation which gives minimum water flow impingement drag on the nozzle openings. Further, note the step in the maneuvering device which deflects water passing below the boat from impacting a nozzle opening.
Figure 7:
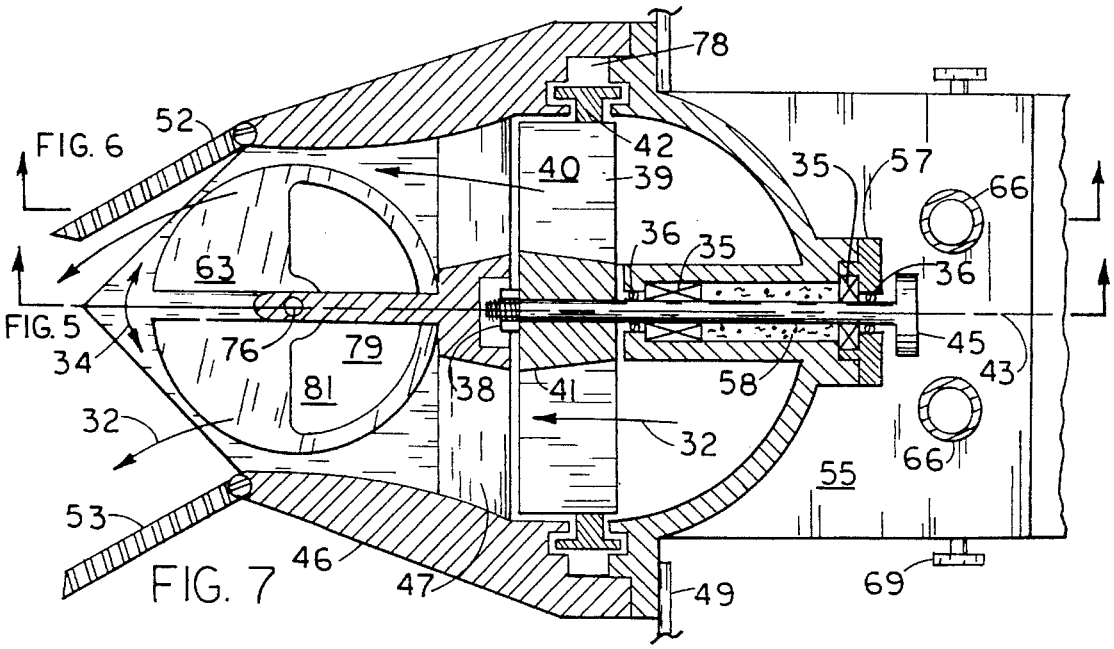
FIG. 7 is a centerline cross sectional plan view, as taken through line 7—7 of FIG. 5, that shows side steering rudders in a forward turn to starboard orientation. This also shows a maneuvering device with its nozzle set in the ahead thrust orientation.

FIG. 5 is a cross sectional view of the improved propulsor 48, as taken through line 5—5 of FIGS. 1 and 7, that shows operation while propelling a boat 49 forward at high speed. Note the inlet housing waterline 31 that is established by structural discontinuity 71 in this instance. Gas, as shown by gas flow arrows 33 is supplied to the upper portion of the rotor vanes 40 of rotor 39 by gas duct 66. Liquid or water flow is shown by liquid flow arrows 32. Liquid is energized by rotating rotor vanes 40 and then passes through the aft housing 46 to exit the unit in a direction substantiality in line with the centerline 75 of the unit. Steering is accomplished by deflection of the rearward discharging fluids by steering rudders such as the port steering rudder 52 shown here. Note that this steering rudder concept optionally has rudders that extend below an external waterline 30 that is established at high speeds by water flow breaking off of the aft housing 46 at step 72. This extended rudder concept, while adding some additional resistance at high speed, provides best low speed steering and, as an added advantage, provides need for less rudder deflection for steering at high speeds.

Liquid enters the inlet housing 55 through grille bars 56 in this preferred inlet configuration. The inlet bars 56 are normally airfoil shaped to minimize resistance and pressure losses. The inlet shape at the inlet bars 56 is normally a noncircular shape with a rectangular shape preferred. A noncircular inlet shape would, of course, transition to a round shape at the rotor 39. Closing of the curvilinear inlet flow directing valve 69 is done in the direction of directional arrow 34. Closing of the inlet flow directing valve 69 controls and can stop the gas flow, as indicated by gas flow directional arrows 33, resulting in full liquid flow to the rotor as is discussed more in a following discussion concerning FIG. 6.

Also shown in FIG. 5 are the horizontal centerline plane 44, rotor shaft 45, rotor attachment fastener 38, rotor hub 41, and rotor vane ring 42 and housing recess 78. Further shown are bearings 35, seals 36, oil fill plug 58, oil 59, thrust bearing cartridge 57, and debris cutter 60. Note that the debris cutter includes an inspection port covert. Additional items include a center mounted maneuvering device 63 including flow directing maneuvering device nozzle 79 and its inlet opening 81 and discharge opening 82, maneuvering device centerline 76, shafts 61, gears 37, maneuvering device drive motor 68 which in this preferred case is an electric servo motor, and protective cover 74 for the shaft, gears, and the like.

Figure 6:
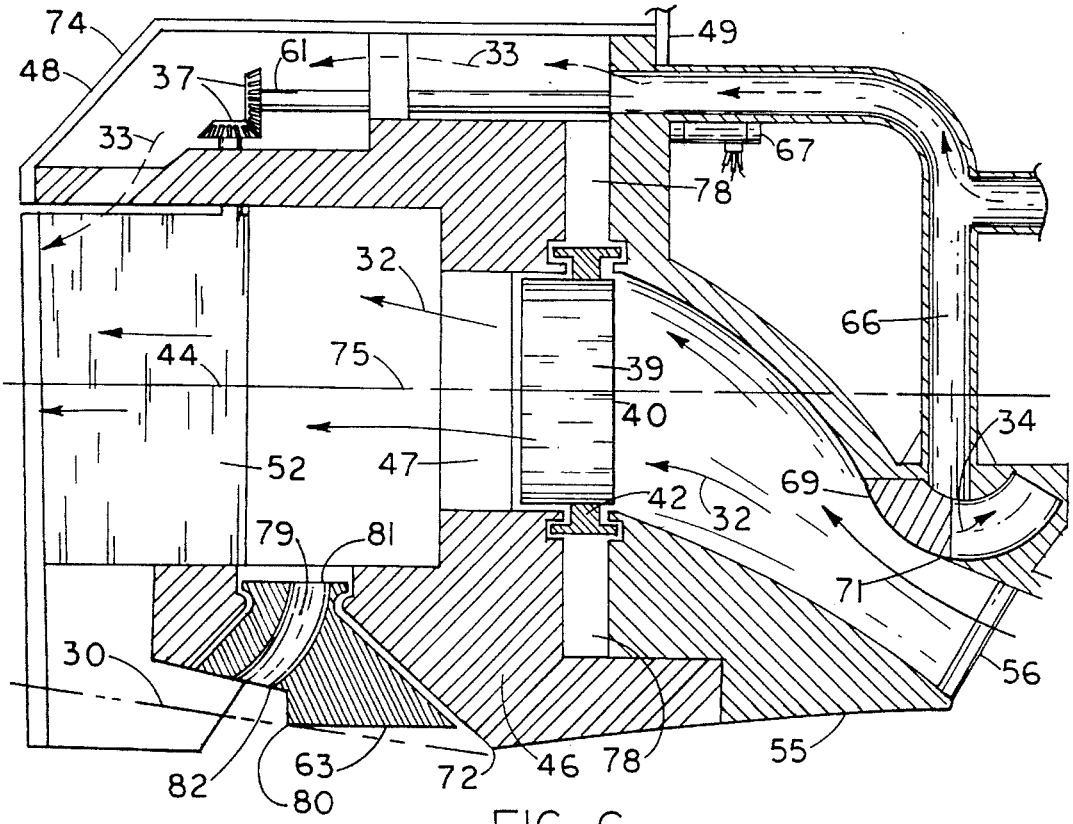
FIG. 6 presents a cross sectional view, as taken through line 6—6 of FIG. 1, that shows a preferred embodiment of the instant invention through plane 6—6.

FIG. 6 presents a cross sectional view, as taken through line 6—6 of FIGS. 1 and 7, that is off to the port side of the instant inventive propulsor 48. This shows the gas flow to the rotor 39 and rotor vanes 40 cut off since the inlet flow directing valve 69 is closed thereby eliminating gas flow. The gas flow is then directed out through gas duct 66 to an opening under the cover as can be seen from observation of gas flow directional arrows 33. Liquid discharged from the rotor vanes 40 passes through flow straightening vanes 47 as indicated by liquid flow directional arrows 32. The liquid flow helps in the elimination of the gas flow in this preferred embodiment as can be seen from further observation of gas flow directional arrows 33.

Further, in addition to eliminating gas flow when closed, the shape of the optimal curvilinear shaped, preferably circular arc shaped, inlet flow directing valve 69 causes the inlet liquid flow to follow its curved surfaces. This tendency of liquid flow to follow curved surfaces is commonly known as the Coanda Effect. The result is an inlet flow directing valve 69 that requires minimum rotational force or torque to operate and that has minimum resistance to liquid flow.

So the basic concept of the Hydro-Air Drive allows operation with a rotor 39 and rotor vanes 40 that are either partially or fully flooded with liquids. Normal and preferred operation utilizes the fully flooded rotor 39, as shown in FIG. 6, at low boat speeds and the partially flooded rotor 39 and rotor vanes 40, as shown in FIG. 5, at high boat speeds. This makes for a high liquid flow rate and low discharge velocity at low boat speeds and a low liquid flow rate and high discharge velocity at high boat speeds which are the optimum performance conditions. A main advantage of and reason for the Hydro-Air Drive is that, as previously discussed, inlet pressure recoveries are about 90 percent over the lower half of the rotor at its inlet and only about 50 percent over the upper half for a normal water jet inlet. As such, the Hydro-Air Drive is always working in optimum inlet pressure recovery conditions, and hence optimum overall efficiencies, at high boat speeds. That coupled with its ability, in its preferred embodiments, to have its rotor 39 and hence its rotor vanes 40 filled with liquids at high boat speeds results in very high thrust values over the entire speed range of the boat. This is a vastly superior concept to that of the conventional water jet which has a very limited range of operation and is subject to severe performance decays with any aeration of the water at their rotor inlets.

FIG. 7 is a cross sectional top plan view, as taken through line 7—7 of FIG. 5, that shows port steering rudder 52 and starboard steering rudder 53 turned to cause steering to starboard. The maneuvering device 63 is shown oriented such that its nozzle inlet opening 81 is biased forward, as was the case for FIG. 5, in this instance for minimum water impingement. There is no, or insignificant, fluid flow through the maneuvering device's nozzle 79 in this full ahead thrust situation.

Figure 8:
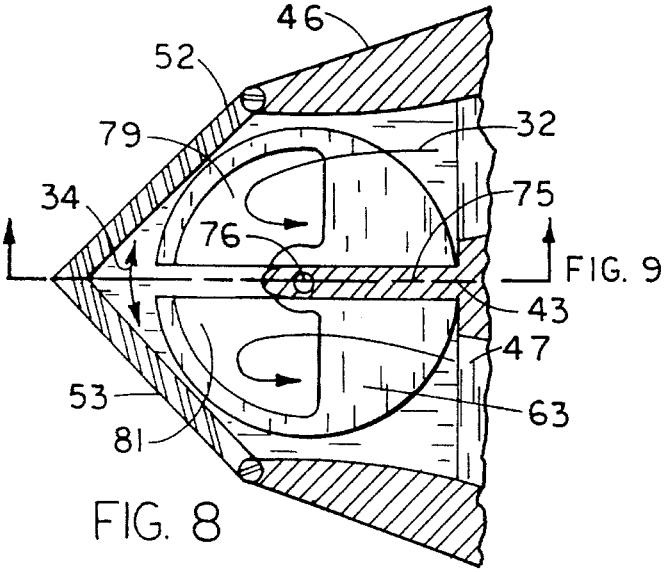
FIG. 8 is a partial cross sectional plan view on centerline, as taken through line 8—8 of FIG. 9, that shows the side steering rudders angled inward which causes a blocking of liquid flow aft. This directs the liquid flow downward and out through the maneuvering device which in this instance is generating a reversing thrust or force.
Figure 9:
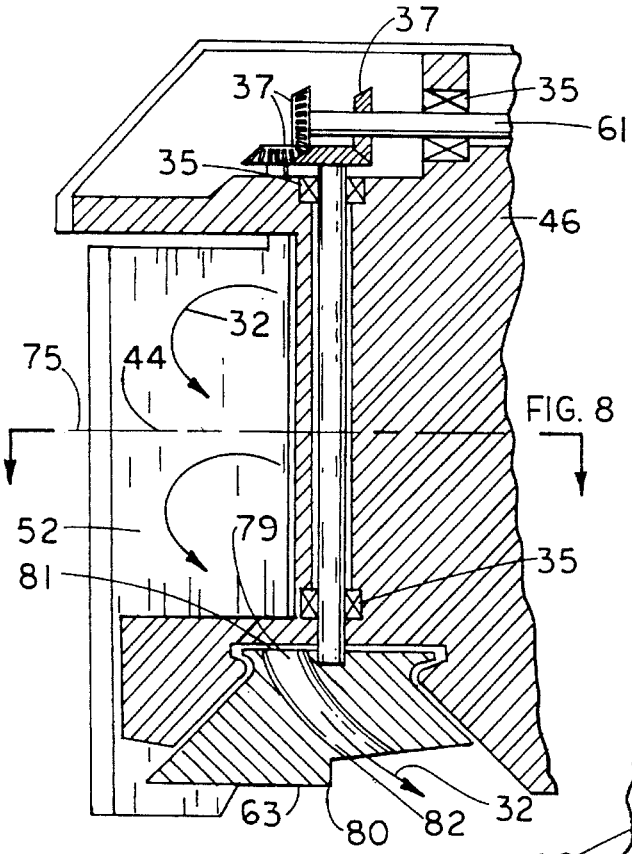
FIG. 9 presents a partial cross sectional view on centerline, as taken through line 9—9 of FIG. 8, that shows the side steering rudders angled inward or closed, as is the case of FIG. 8, with the rotor discharge flow being directed through a nozzle of the maneuvering device to thereby create a reversing thrust.

FIG. 8 is a partial cross sectional top plan view, as taken through line 8—8 of FIG. 9, that shows the same components as that presented in the description of FIG. 7 but with the port steering rudder 52 and starboard steering rudder 53 closed to block fluid flow from exiting from the rotor vanes in a direction rearward and generally in line with the propulsor centerline 75. This flow blockage rearward then directs the fluid flow to the maneuvering device's nozzle inlet opening 81. In this illustration, the maneuvering device 63 is oriented by rotation for full reverse thrust as is indicated by liquid flow directional arrows 32 in this version. Rotation of the maneuvering device 63 is indicated by directional arrow 34.

FIG. 9 presents a partial cross sectional view, as taken through line 9—9 of FIG. 8, that shows the port side rudder 52 in the closed position and direction of the liquid flow directional arrows 32. The directed thrust in this instance causes a reversing of the boat. Note that, while more complicated and less desirable, other devices to block rearward fluid flow such as a flap, not shown, disposed between the side steering rudders are considered well within the scope of the instant invention.

Figure 10:
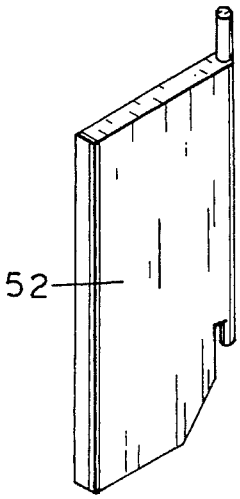
FIG. 10 is an isometric drawing of the port side steering rudder.

FIG. 10 is an isometric drawing of the port side rudder 52.

Figure 11:
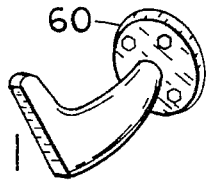
FIG. 11 presents an isometric drawing of a rotor debris cutter as affixed to the inspection cover.

FIG. 11 presents an isometric drawing of the debris cutter 60. Note that it includes an inspection port cover in this preferred embodiment.

Figure 12:
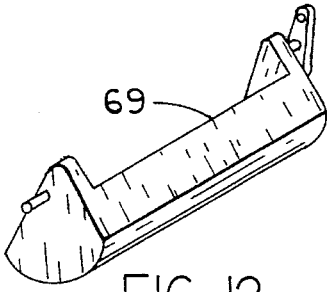
FIG. 12 shows a rotatable inlet flow control valve member in an isometric perspective.

FIG. 12 is an isometric drawing of an inlet flow direction valve 69. In this instance it is a rotating design that requires minimal torque for operation.

Figure 13:
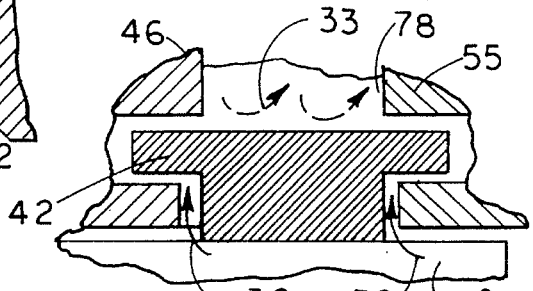
FIG. 13 is an enlarged view of a rotor vane ring, as taken from localized view 13 that is positioned at the upper right hand portion of the rotor vane ring of FIG. 5, that shows details of the rotor vane ring and its labyrinth flow sealing design.

FIG. 13 is an enlarged view, as taken from the circular view 13 of FIG. 5 showing a rotor vane ring 42 that creates a labyrinth seal along with spaces defined by inlet housing 55 and aft housing 46. Liquid flow is shown by liquid flow directional arrows 32 and gas flow by gas flow directional arrows 33. Note that peripheral portions of the rotor vanes 40 forward and aft of the rotor vane ring 42 are not enclosed by a rotor vane ring in this instance. This is an important concept since the exposed peripheral portions of the rotor vanes 40 forward of the rotor vane ring 42 build up a positive liquid pressure which prevents gas from migrating into the rotor vane 40 at the forward end of the rotor vane ring 42. Further, the exposed peripheral portion of the rotor vanes 40 aft of the rotor vane ring 42 provide for best efficiency in some cases although a full longitudinal vane length rotor vane ring 42 is the preferred embodiment of the instant invention.

Figure 14:
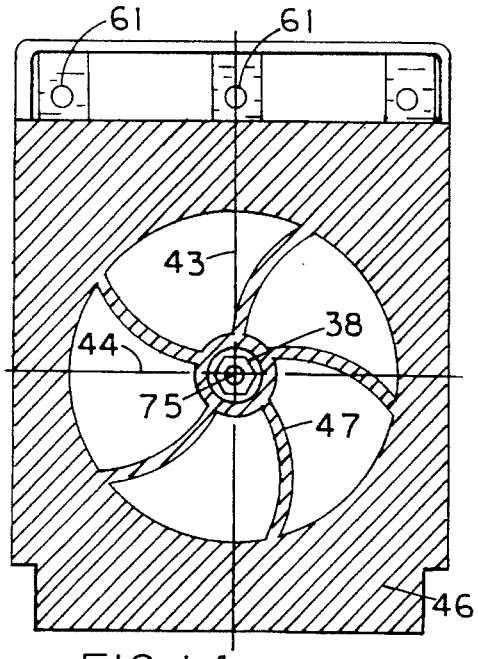
FIG. 14 illustrates a cross sectional view of the aft housing as taken through line 14—14 of FIG. 5. Note the flow straightening vanes in this housing.

FIG. 14 is a cross sectional view, as taken through line 14—14 of FIG. 5, showing the aft housing 46 and flow straightening vanes 47.

Figure 15:
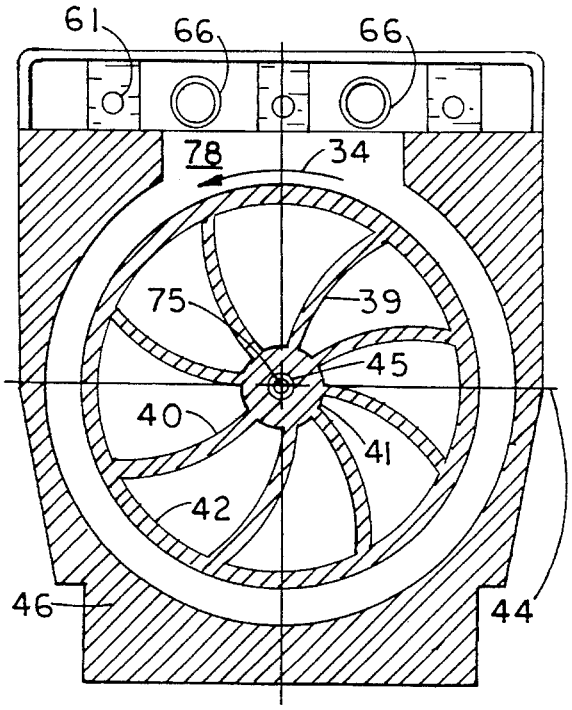
FIG. 15 is a cross sectional view, as taken through line 15—15 of FIG. 5, that shows the rotor as positioned inside of its housing. Note the large opening above the rotor vane ring which freely allows gas flow into the opening around the rotor vane ring periphery.

FIG. 15 presents a cross sectional view, as taken through line 15—15 of FIG. 5, that illustrates the rotor 39, including a rotor vane ring 42, internal to aft housing 46. Note the housing recess 78 around the outside of the rotor vane ring 42 which is normally mostly filled with gas since any liquid is pumped out of the open upper portion of the space outside of the rotor vane ring 42. The rotor vane ring 42 is considered as being part of structure encircling the rotor vanes 40 for purposes of this invention. Note also that it is not necessary to have a rotor vane ring 42 to have the instant invention fully functional. It is even possible to eliminate structure around a portion of, or all of, the upper half of the rotor vanes 40, as would be the case in FIG. 15 if the rotor vane ring 42 were eliminated, and still have a fully functioning version of the instant invention. Although such is not shown, it is considered within the scope and spirit of the instant invention since elimination of the rotor vane ring 42 from FIG. 15 would illustrate such a situation.

Figure 16:
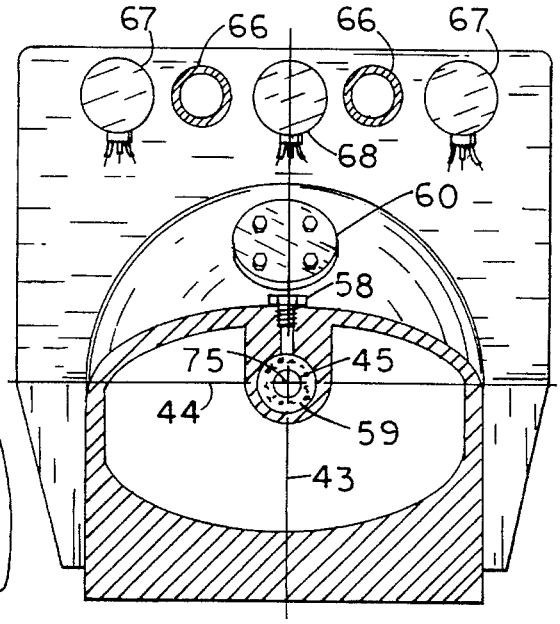
FIG. 16 presents a cross sectional view, as taken through line 16—16 of FIG. 5, that shows a typical inlet duct shape that transitions between the normally rectangular inlet and the round rotor.

FIG. 16 is a partial cross sectional view, as taken through line 16—16 of FIG. 5, that shows the inlet housing 55 and maneuvering device drive motor 68 and side rudder drive motors 67. Note that the inlet flow passageway is in a transition shape going from the a rectangular inlet to the round duct at the rotor inlet.

Figure 17:
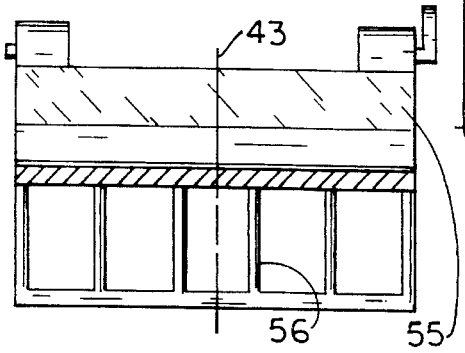
FIG. 17 is a cross sectional view, as taken through line 17—17 of FIG. 5, that shows the normally rectangular inlet which in this case includes a series of inlet grille bars.

FIG. 17 is a partial cross sectional view, as taken through line 17—17 of FIG. 5, that shows a rectangular inlet in inlet housing 55 and inlet grille bars 56.

Figure 18:
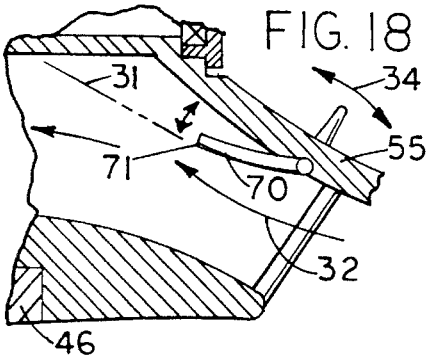
FIG. 18 presents a partial cross sectional view, as taken through a vertical centerline plane, of an alternative inlet flow valve which in this case is more flap-like than circular.

FIG. 18 presents an optional inlet directional flow control valve 70 that is in the form of a hinged flap. Note that, while workable, this flap like design has more resistance to liquid flow and also requires more operational torque than the inlet flow directional valve presented in FIGS. 5 and 6.

Figure 19:
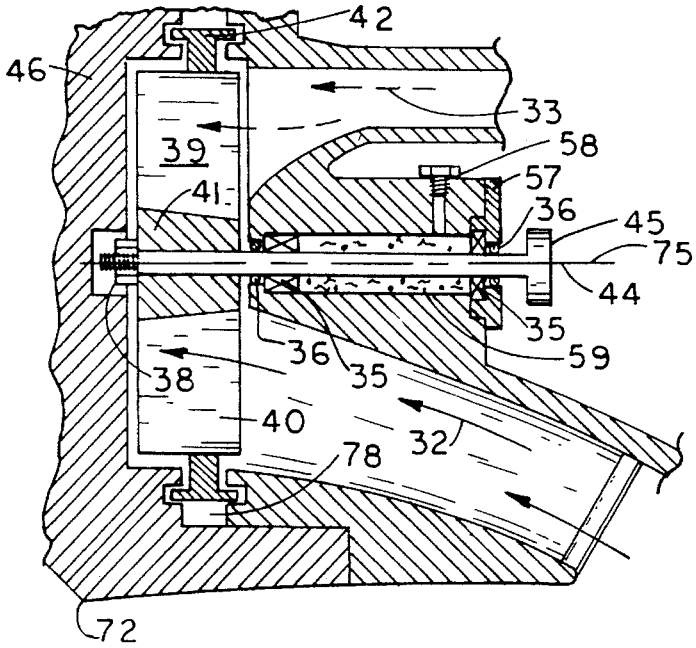
FIG. 19 is another partial cross sectional view, as taken through a vertical centerline plane, that illustrates a very simple inlet where there is no inlet flow control valve and the liquid flow is simply directed in its majority to a lower portion of the rotor.

FIG. 19 presents an optional inlet design where there is no inlet flow directing valve and the incoming liquid is simply directed to the lower portions of the rotor vanes 40. This simple concept can only function with gas to the upper portions of the rotor vanes 40 and liquid to the lower portions of the rotor vanes 40 at all speeds.

Figure 20:
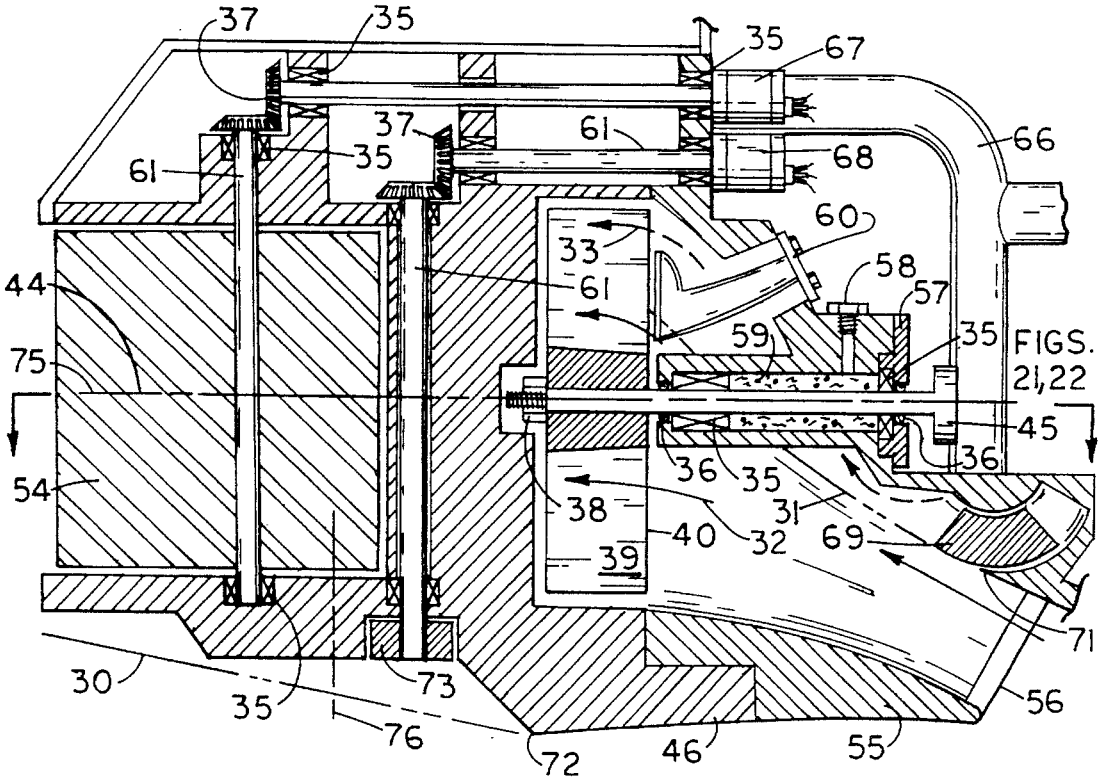
FIG. 20 is a centerline cross sectional view, as taken through line 20—20 of FIG. 1, that is similar to that presented in FIG. 5 but having a slightly different rudder and maneuvering device layout. In this case there is a single center mounted rudder with the maneuvering device composed of port and starboard maneuvering devices that are driven by a center gear as is best seen from examination of FIGS. 21 and 22 which follow.

FIG. 20 is a cross sectional view, as taken through line 20—20 of FIG. 1, that shows an optional version of the instant invention steering rudder and maneuvering device. It functions in the same way as that presented in FIGS. 5–9 except that a balanced center rudder 54 is used rather than side rudders and two maneuvering devices are used rather than one. The following FIGS. 21–24 describe its workings in more detail. FIG. 20 also shows a housing structural discontinuity or housing water separating step 72 that acts to prevent water flow from impinging on the maneuvering device(s) and their nozzle openings.

Figure 21:
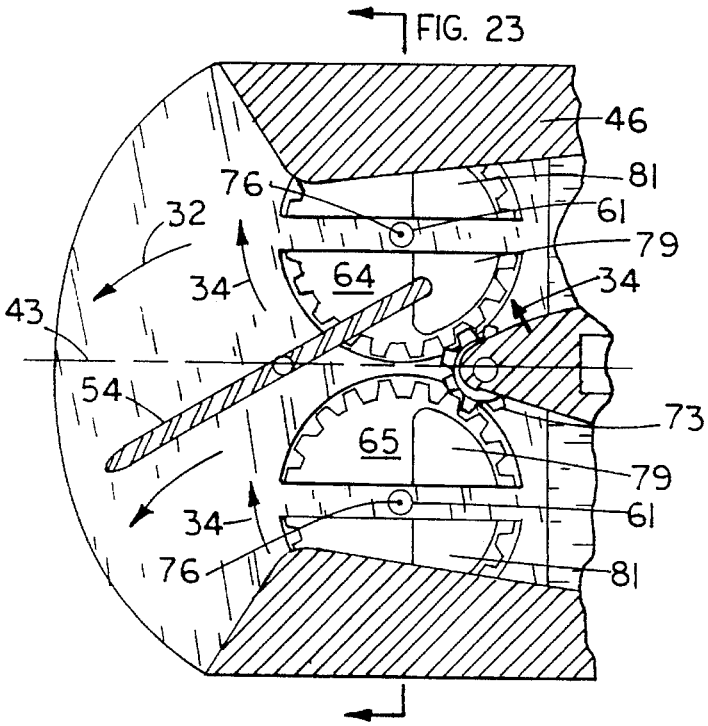
FIG. 21 is a partial cross sectional plan view as taken on centerline, as bisects FIG. 20 on line 21—21, that shows a center discharge rudder that is angled causing a turn to starboard here. Note the two rotatable maneuvering devices in this instance.

FIG. 21 is a partial cross sectional view, as taken through line 21—21 of FIG. 20 that shows a center rudder 54 as turned slightly to effect a turn to starboard. There is a port maneuvering device 64 and a starboard maneuvering device 65 that are both driven by drive gear 73 in this instance. The maneuvering device nozzles 79 are set for forward thrust in instance.

Figure 22:
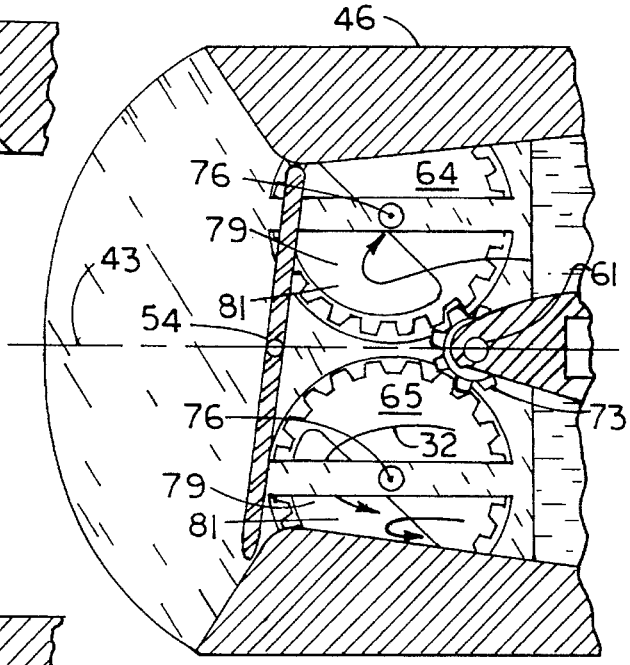
FIG. 22 is a similar partial cross sectional plan view, as taken through line 22—22 of FIG. 20, to that presented in the description of FIG. 21. Note that the rudder blocks reverse flow as oriented here such that the maneuvering device in this instance is directing a reverse turn to starboard.

For purposes of definition in this application, a first maneuvering device can be the centered maneuvering device shown in prior FIGS. 7 and 8 as item 63 or one of the maneuvering devices 64 shown in FIGS. 21 and 22 with a second maneuvering device being the item 65 of FIGS. 21 and 22. If a first and a second maneuvering device are called for it is meant to refer to multiple maneuvering devices similar to those shown in FIGS. 21 and 22. A first steering means or steering rudder can be the steering rudder 54 of FIGS. 21 and 22 or one of the steering rudders 52 of FIGS. 7 and 8 with a second steering rudder being item 53 of FIGS. 7 and 8. If a first and a second steering means or steering rudders are called for it is meant to multiple steering rudders such as shown in FIGS. 8 and 9.

FIG. 22 is another partial cross sectional view, as taken though line 22—22 of FIG. 20, that has the center rudder 54 in position to block flow rearward and therefore downward through the port maneuvering device 64 and starboard maneuvering device 65. In this illustration, reversing forces are being generated to cause a reverse turn to starboard.

Figure 24:
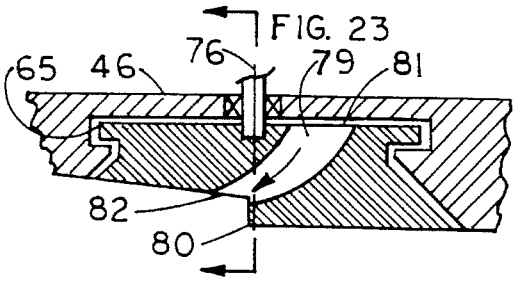
FIG. 24 is a partial cross sectional view, as taken through line 24—24 of FIG. 23 that shows the maneuvering flow directing nozzle and the discharge fluid passing through same to create forward thrust in this instance.
Figure 23:
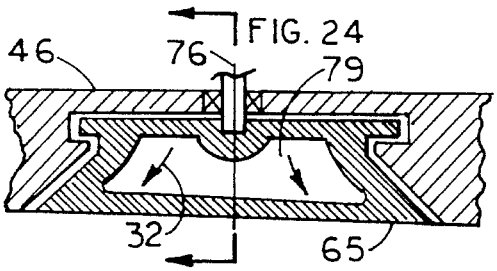
FIG. 23 presents a partial cross sectional view, as taken through line 23—23 of FIGS. 21 and 24, that shows one of the maneuvering devices of FIG. 21. This shows a portion of the nozzle as disposed inside of the maneuvering device.

FIG. 23 is a partial cross sectional view, as taken though line 23—23 of FIGS. 21 and 24, that shows the port maneuvering device's nozzle 79 internal to the maneuvering device.

FIG. 24 is a partial cross sectional view, as taken through line 24—24 of FIG. 23, that shows liquid flow directional arrows 32 that are being discharged rearward through the maneuvering device's nozzle 79 to create a forward thrust.

While the invention has been described in connection with preferred and several alternative embodiments, it will be understood that there is no intention to thereby limit the invention. On the contrary, there is intended to be covered all alternatives, modifications and equivalents as may be included within the spirit and scope of the invention as defined by the appended claims, which are the sole definition of the invention.

What I claim is:

1. In an improved propulsor for propelling a marine vehicle, said improved propulsor including a fluid inlet structure, a rotor having rotor vanes capable of accelerating fluids when rotating, a liquid flow to said rotor vanes when said rotor is rotating, said rotor vanes at least over a part of their length in the direction of fluid flow disposed internally to structure that extends around a majority of and up to and including a full 360 degree periphery of said rotor vanes, and rotor drive means, the improvement comprising:

gas supply means including a gas flow that supplies gas to a forward portion of the rotor vanes when the rotor is rotating and the improved propulsor is propelling the marine vehicle at high speeds;

fluid flow separating means to create a separation of the liquid flow and the gas flow upstream of said rotor vanes when said rotor is rotating and when the improved propulsor is propelling the marine vehicle at high speeds whereby said rotor vanes receive primarily gases from the gas flow over at least a majority of 180 degrees of said rotor's rotation and receive primarily liquids from the liquid flow over at least a majority of 180 degrees of said rotor's rotation with said gas flow and said liquid flow principally separated upstream of the rotor vanes.

2. The improved propulsor of claim 1 wherein a waterline separates the gas flow and the liquid flow upstream of said rotor vanes.

3. The improved propulsor of claim 1 wherein said fluid flow separating means is, at least in part, a structural discontinuity.

4. The improved propulsor of claim 1 wherein the fluid flow separating means comprises an inlet flow directing device such that adjustment of said inlet flow directing device can accomplish a varying of the level of the waterline upstream of the rotor vanes.

5. The improved propulsor of claim 4 wherein the inlet flow directing device comprises, at least in part, a curvilinear surface with said curvilinear surface, at least during part of its operation, is exposed to inlet fluid flow.

6. The improved propulsor of claim 5 wherein said inlet flow directing device is rotatable.

7. The improved propulsor of claim 4 wherein the inlet flow directing device comprises, at least in part, a flap-like device.

8. The improved propulsor of claim 4 wherein the inlet flow directing device regulates, at least partially, gas flow to the rotor vanes.

9. The improved propulsor of claim 1 wherein the fluid inlet structure has a noncircular shape forward of the rotor vanes.

10. The improved propulsor of claim 1 wherein the fluid inlet structure is proximal to and forward of radially extending portions of the rotor vanes thereby essentially blocking liquid flow to portions of the rotor vanes during rotor rotation.

11. The improved propulsor of claim 10 wherein said rotor vane ring is at least partially inset into a housing recess.

12. The improved propulsor of claim 11 wherein gas is supplied to the housing recess.

13. The improved propulsor of claim 11 wherein a labyrinth seal restricts fluid leakage around the rotor vane ring.

14. The improved propulsor of claim 1 which further comprises a rotor vane ring that is in mechanical communication with and proximal a 360 degree periphery of said rotor vanes.

15. The improved propulsor of claim 1 wherein a debris cutting device is positioned proximal to and forward of forward radial portions of the rotor vanes such that rotor rotation causes a cutting action between the rotor vanes and the debris cutting device and where said debris cutting device can be removed through an inspection port.

16. The improved propulsor of claim 1 wherein the rotor vanes can be run in an essentially full liquid condition at low vehicle speeds.

17. The improved propulsor of claim 1 wherein at least part of the gas flow supplied to the rotor vanes is from an engine exhaust.

18. The improved propulsor of claim 1 which further comprises fluid flow straightening vanes positioned downstream of the rotor vanes.

19. The improved propulsor of claim 1 which further comprises a common lubrication supply for multiple rotor shaft bearings with said lubrication supply filled from inside the vehicle.

20. The improved propulsor of claim 1 which further comprises a steering and fluid flow blocking mechanism with said steering and fluid flow blocking mechanism capable of blocking a majority of fluid discharge in an aft direction such that said fluid discharge is then redirected to a first maneuvering device that is capable of providing maneuvering forces over at least a majority of 180 degrees of rotation and wherein said first maneuvering device includes a nozzle and said nozzle has a discharge opening that is biased to one side of a centerline of said first maneuvering device.

21. The improved propulsor of claim 20 wherein said first maneuvering device includes a water separating step.

22. The improved propulsor of claim 20 wherein said steering and fluid flow blocking mechanism comprises a first steering rudder with said first steering rudder capable of, at least partially, acting as a fluid flow blocking device.

23. The improved propulsor of claim 20 which further comprises a second maneuvering device with movement of said first and said second maneuvering device in communication.

24. In an improved propulsor for propelling a marine vehicle, said improved propulsor including a fluid inlet structure, a rotor having rotor vanes capable of accelerating fluids when rotating, a liquid flow to said rotor vanes when said rotor is rotating, said rotor vanes in mechanical communication with a rotor vane ring that encircles a full 360 degree periphery of the rotor vanes, and rotor drive means, the improvement comprising:

gas supply means including a gas flow that supplies gas to a forward portion of the rotor vanes when the rotor is rotating and the improved propulsor is propelling the marine vehicle at high speeds;

fluid flow separating means to create a separation of the liquid flow and the gas flow upstream of said rotor vanes such that the rotor vanes, when rotating and when the improved propulsor is propelling the marine vehicle at high speeds, receive primarily gases from the gas flow over at least a majority of 180 degrees of said rotor's rotation and receive primarily liquids from the liquid flow over at least a majority of 180 degrees of said rotor's rotation with said gas flow and said liquid flow principally internal to said fluid inlet structure and separated upstream of and proximal to the rotor vanes.

25. The improved propulsor of claim 24 wherein a waterline separates the gas flow and the liquid flow upstream of said rotor vanes.

26. The improved propulsor of claim 25 wherein said waterline is at least partially established by the fluid flow separating means.

27. The improved propulsor of claim 24 wherein said fluid flow separating means is, at least in part, a structural discontinuity.

28. The improved propulsor of claim 24 wherein the fluid flow separating means comprises an inlet flow directing device such that adjustment of said inlet flow directing device can accomplish a varying of the level of the waterline upstream of the rotor vanes.

29. The improved propulsor of claim 28 wherein the inlet flow directing device comprises, at least in part, a curvilinear surface with said curvilinear surface, at least during part of its operation, is exposed to inlet fluid flow.

30. The improved propulsor of claim 28 wherein the inlet flow directing device comprises, at least in part, a flap-like device.

31. The improved propulsor of claim 24 wherein the fluid inlet structure has a noncircular shape forward of the rotor vanes.

32. The improved propulsor of claim 24 where in the fluid inlet structure is proximal to and forward of radially extending portions of the rotor vanes over a part of rotor rotation thereby essentially blocking liquid flow to portions of the rotor vanes during rotor rotation.

33. The improved propulsor of claim 24 wherein said rotor vane ring is at least partially inset into a housing recess.

34. The improved propulsor of claim 33 wherein gas is supplied to the housing recess.

35. The improved propulsor of claim 33 wherein a labyrinth seal restricts fluid leakage around the rotor vane ring.

36. The improved propulsor of claim 24 wherein the rotor vanes can be run in an essentially full liquid condition at low vehicle speeds.

37. The improved propulsor of claim 24 wherein at least part of the gas flow supplied to the rotor vanes is from an engine exhaust.

38. The improved propulsor of claim 24 which further comprises fluid flow straightening vanes positioned downstream of the rotor vanes.

39. The improved propulsor of claim 24 which further comprises a steering and fluid flow blocking mechanism with said steering and fluid flow blocking mechanism capable of blocking a majority of fluid discharge in an aft direction such that said fluid discharge is then redirected to a first maneuvering device that is capable of providing maneuvering forces over at least a majority of 180 degrees of rotation and wherein said first maneuvering device includes a nozzle and said nozzle has a discharge opening that is biased to one side of a centerline of said first maneuvering device.

40. The improved propulsor of claim 39 wherein said first maneuvering device includes a water separating step.

41. The improved propulsor of claim 39 which further comprises a second maneuvering device with movement of said first and said second maneuvering device in communication.

42. In an improved propulsor for propelling a marine vehicle, said improved propulsor including a fluid inlet structure, a rotor having rotor vanes capable of accelerating fluids when rotating, said rotor vanes at least over a part of their length in the direction of fluid flow disposed internally to structure that extends essentially around a full 360 degree periphery of said rotor vanes, and rotor drive means, the improvement comprising:

a portion of the fluid inlet structure is forward of radially extending portions of the rotor vanes such that said inlet structure causes a blocking of liquid flow to the rotor vanes over at least a majority of 180 degrees of rotor rotation;

gas supply means upstream of at least a portion of said rotor vanes with said gas supply supplying gas to said rotor vanes during a majority of 180 degrees of rotor rotation that is blocked from receiving liquid flow whereby there is a substantial separation of gases and liquids upstream of said rotor vanes when said rotor is rotating and when the improved propulsor is propelling the marine vehicle at high speed.

43. The improved propulsor of claim 42 wherein a waterline separates the gas flow and the liquid flow upstream of said rotor vanes.

44. The improved propulsor of claim 42 which further comprises a rotor vane ring that is in mechanical communication with and proximal a 360 degree periphery of said rotor vanes.

45. The improved propulsor of claim 44 wherein said rotor vane ring is at least partially inset into a housing recess.

46. The improved propulsor of claim 45 wherein gas is supplied to the housing recess.

47. The improved propulsor of claim 45 wherein a labyrinth seal restricts fluid leakage around the rotor vane ring.

48. The improved propulsor of claim 42 wherein at least part of the gas flow supplied to the rotor vanes is from an engine exhaust.

49. The improved propulsor of claim 42 which further comprises a common lubrication supply for multiple rotor shaft bearings with said lubrication supply filled from inside the vehicle.

50. The improved propulsor of claim 42 which further comprises a steering and fluid flow blocking mechanism with said steering and fluid flow blocking mechanism capable of blocking a majority of fluid discharge in an aft direction such that said fluid discharge is then redirected to a first maneuvering device that is capable of providing maneuvering forces over at least a majority of 180 degrees of rotation and wherein said first maneuvering device includes a nozzle and said nozzle has discharge opening that is biased to one side of a centerline of said first maneuvering device.

51. The improved propulsor of claim 50 wherein said first maneuvering device includes a water separating step.

52. The improved propulsor of claim 50 which further comprises a second maneuvering device with movement of said first and said second maneuvering device in communication.

53. In an improved propulsor for propelling a marine vehicle with said improved propulsor including a rotor having rotor vanes, a liquid flow to said rotor vanes when said rotor is rotating and propelling the marine vehicle, and said rotor vanes capable of accelerating fluids when said rotor is rotating to thereby provide propulsive thrust, the improvement comprising:

structure enclosing a lower portion of said rotor vanes over at least a majority of 180 degrees of rotation of said rotor; a gas flow supplied to a forward portion of said rotor vanes when the rotor is rotating and the improved propulsor is propelling the marine vehicle at high speeds, said rotor vanes receive primarily gases from the gas flow over at least a majority of 180 degrees of said rotor's rotation and receive primarily liquids from the liquid flow over at least a majority of 180 degrees of said rotor's rotation with said gas flow and said liquid flow principally separated upstream of the rotor vanes when the rotor is rotating and propelling the marine vehicle at high speeds; and which further comprises a rotor vane ring that is in mechanical communication with and proximal a 360 degree periphery of said rotor vanes.

54. The improved propulsor of claim 53 wherein a waterline separates the gas flow and the liquid flow upstream of said rotor vanes.

55. The improved propulsor of claim 53 which further comprises a fluid flow separating means positioned forward of said rotor vanes.

56. The improved propulsor of claim 55 wherein said fluid flow separating means is, at least in part, a structural discontinuity.

57. The improved propulsor of claim 55 wherein the fluid flow separating means comprises an inlet flow directing device such that adjustment of said inlet flow directing device can accomplish a varying of the level of the waterline upstream of the rotor vanes.

58. The improved propulsor of claim 57 wherein the inlet flow directing device comprises, at least in part, a curvilinear surface with said curvilinear surface, at least during part of its operation, is exposed to inlet fluid flow.

59. The improved propulsor of claim 58 wherein said flow directing device is rotatable.

60. The improved propulsor of claim 57 wherein the inlet flow directing device comprises, at least in part, a flap-like device.

61. The improved propulsor of claim 57 wherein the inlet flow directing device regulates, at least partially, gas flow to the rotor vanes.

62. The improved propulsor of claim 53 wherein a debris cutting device is positioned proximal to and forward of forward radial portions of the rotor vanes such that rotor rotation causes a cutting action between the rotor vanes and the debris cutting device and where said debris cutting device can be removed through an inspection port.

63. The improved propulsor of claim 53 wherein the rotor vanes can be run in an essentially full liquid condition at low vehicle speeds.

64. The improved propulsor of claim 53 wherein at least part of the gas flow supplied to the rotor vanes is from an engine exhaust.

65. The improved propulsor of claim 53 which further comprises fluid flow straightening vanes positioned downstream of the rotor vanes.

66. The improved propulsor of claim 53 which further comprises a common lubrication supply for multiple rotor shaft bearings with said lubrication supply filled from inside the vehicle.

67. The improved propulsor of claim 53 which further comprises a steering and fluid flow blocking mechanism with said steering and fluid flow blocking mechanism capable of blocking a majority of fluid discharge in an aft direction such that said fluid discharge is then redirected to a first maneuvering device that is capable of providing maneuvering forces over at least a majority of 180 degrees of rotation and wherein said first maneuvering device includes a nozzle and said nozzle has discharge opening that is biased to one side of a centerline of said first maneuvering device.

68. The improved propulsor of claim 67 wherein said first maneuvering device includes a water separating step.

69. The improved propulsor of claim 67 which further comprises a second maneuvering device with movement of said first and said second maneuvering device in communication.

70. In an improved propulsor for propelling a marine vehicle with said improved propulsor including a rotor having rotor vanes, a liquid flow to said rotor vanes when said rotor is rotating and propelling the marine vehicle, and said rotor vanes capable of accelerating fluids when said rotor is rotating to thereby provide propulsive thrust, the improvement comprising:

structure enclosing a lower portion of an outer periphery of said rotor vanes over at least a majority of 180 degrees of rotation of said rotor; a gas flow supplied to a forward portion of said rotor vanes when the rotor is rotating and the improved propulsor is propelling the marine vehicle at high speeds; and said rotor vanes receive primarily gases from the gas flow over at least a majority of 180 degrees of said rotor's rotation and receive primarily liquids from the liquid flow over at least a majority of 180 degrees of said rotor's rotation with said gas flow and said liquid flow primarily separated upstream of the rotor vanes when the rotor is rotating and propelling the marine vehicle at high speeds.

71. The improved propulsor of claim 70 wherein a waterline separates the gas flow and the liquid flow upstream of said rotor vanes.

72. The improved propulsor of claim 70 which further comprises a fluid flow separating means positioned forward of said rotor vanes.

73. The improved propulsor of claim 72 wherein said fluid flow separating means is, at least in part, a structural discontinuity.

74. The improved propulsor of claim 72 wherein the fluid flow separating means comprises an inlet flow directing device such that adjustment of said inlet flow directing device can accomplish a varying of the level of the waterline upstream of the rotor vanes.

75. The improved propulsor of claim 74 wherein the inlet flow directing device comprises, at least in part, a curvilinear surface with said curvilinear surface, at least during part of its operation, is exposed to inlet fluid flow.

76. The improved propulsor of claim 75 wherein said inlet flow directing device is rotatable.

77. The improved propulsor of claim 74 wherein the inlet flow directing device comprises, at least in part, a flap-like device.

78. The improved propulsor of claim 74 wherein the inlet flow directing device regulates, at least partially, gas flow to the rotor vanes.

79. The improved propulsor of claim 70 which further comprises a rotor vane ring that is in mechanical communication with and proximal a 360 degree periphery of said rotor vanes.

80. The improved propulsor of claim 70 where in a debris cutting device is positioned proximal to and forward of forward radial portions of the rotor vanes such that rotor rotation causes a cutting action between the rotor vanes and the debris cutting device and where said debris cutting device can be removed through and inspection port.

81. The improved propulsor of claim 70 wherein the rotor vanes can be run in an essentially full liquid condition at low vehicle speeds.

82. The improved propulsor of claim 70 wherein at least part of the gas flow supplied to the rotor vanes is from an engine exhaust.

83. The improved propulsor of claim 70 which further comprises fluid flow straightening vanes positioned downstream of the rotor vanes.

84. The improved propulsor of claim 70 which further comprises a steering and fluid flow blocking mechanism with said steering and fluid flow blocking mechanism capable of blocking a majority of fluid discharge in an aft direction such that said fluid discharge is then redirected to a first maneuvering device that is capable of providing maneuvering forces over at least a majority of 180 degrees of rotation and wherein said first maneuvering device includes a nozzle and said nozzle has a discharge opening that is biased to one side of a centerline of said first maneuvering device.

85. The improved propulsor of claim 84 wherein said first maneuvering device includes a water separating step.

86. The improved propulsor of claim 84 which further comprises a second maneuvering device with movement of said first and said second maneuvering device in communication.

87. In an improved propulsor for propelling a marine vehicle with said improved propulsor including means to accelerate fluids to thereby generate propulsive thrust and a steering and fluid flow blocking mechanism with said steering and fluid flow blocking mechanism capable of blocking a majority of fluid discharge in an aft direction such that said fluid discharge it then redirected to port and starboard maneuvering devices, the improvement comprising:

the port and starboard maneuvering devices are separate and rotatable about their own individual centerlines and positioned proximal to and in mechanical communication with a fixed housing of the propulsor said port and starboard maneuvering devices are in mechanical communication such that they are maintained in a common orientation during rotation, and said port and starboard maneuvering devices are capable of providing maneuvering forces over at least a majority of 180 degrees of rotation.

88. The improved propulsor of claim 87 wherein said port and starboard maneuvering devices include water separating steps.

89. The improved propulsor of claim 87 wherein said steering and fluid flow blocking mechanism comprises a first steering rudder capable of, at least partially, acting as a fluid flow blocking device.

90. The improved propulsor of claim 89 which further comprises a second steering rudder capable of, at least partially, acting as a fluid flow blocking device.

91. The improved propulsor of claim 90 wherein movement of said first and said second steering rudders is in communication.

92. The improved propulsor of claim 89 wherein said first steering rudder is actuated by forces provided by a drive motor.

93. The improved propulsor of claim 89 wherein said first steering rudder is actuated by forces provided through a substantially right angle gear.

94. The improved propulsor of claim 87 wherein mechanical communication between the port and starboard maneuvering devices is accomplished by means of gears and a common drive means actuates said gears.

95. The improved propulsor of claim 87 wherein mechanical communication of said port and said starboard maneuvering devices is, at least in part, by gears.

96. The improved propulsor of claim 87 wherein said port and said starboard maneuvering devices are driven by a common drive means.

97. The improved propulsor of claim 87 which further comprises a water separating housing step positioned to deflect water from the port and the starboard maneuvering devices during high speed operation of the marine vehicle.

98. The improved propulsor of claim 87 wherein inlet openings for nozzles-in said port and starboard maneuvering devices are biased to one side of the centerlines of each of said port and starboard maneuvering devices.

99. The improved propulsor of claim 87 wherein said port and starboard maneuvering devices are actuated by forces provided by a drive motor.

100. The improved propulsor of claim 87 wherein at least one of said maneuvering devices is actuated by forces provided through a substantially right angle gear.

101. In an improved water jet propulsion system for marine vehicles, with said improved waterjet propulsion system including a steering and maneuvering system capable of providing steering in forward and in reverse, the improvement comprising:

a flow blocking means that is capable of redirecting flow that normally provides forward thrust downward to port and starboard maneuvering devices that are separate and rotatable about their own centerlines, said port and starboard maneuvering devices are in mechanical communication by, at least in part, gears disposed proximal their periphery and a connecting gear, and said port and starboard maneuvering devices are capable of providing maneuvering forces over more than 180 degrees of rotation.

102. The improved propulsion system of claim 101 wherein said port and starboard maneuvering devices are actuated by a common prime mover.

* * * * *